United States Patent [19]

Elias

[11] 4,154,252

[45] May 15, 1979

[54] DEVICE FOR USE IN THE WRAPPING OF COINS

[76] Inventor: Jeanne A. Elias, 128 Campos Verde Ct., Los Gatos, Calif. 95030

[21] Appl. No.: 875,424

[22] Filed: Feb. 6, 1978

[51] Int. Cl.[2] ..... G07D 9/06

[52] U.S. Cl. ..... 133/8 R

[58] Field of Search ..... 133/1 R, 1 A, 8 R, 8 A, 133/8 D

[56] References Cited

U.S. PATENT DOCUMENTS 2,567,531 9/1951 South ..... 133/8 R

*Primary Examiner*—Stanley H. Tollberg

*Attorney, Agent, or Firm*—Jack M. Wiseman

[57] ABSTRACT

Devices for use in the wrapping of coins comprising a tray and a coin holder or coin scoop. The tray is formed with receptacles for removably receiving the coin holder. There is a receptacle for each of various denominations of coins. At the forward end of each receptacle is a coin count abutment wall. The extent of the projection of the coin count abutment wall into its associated receptacle is related to a desired count of the coin denomination designated for the receptacle. The coin holder is indexed by the tray for a predetermined location within the receptacle. The filling of the trough of the coin holder with a column of coins of the denomination designated for the receptacle from a rear wall of the trough of the coin holder to the coin count abutment wall will cause the coin holder to carry a predetermined number of coins of the selected denomination.

10 Claims, 8 Drawing Figures

Fig-7
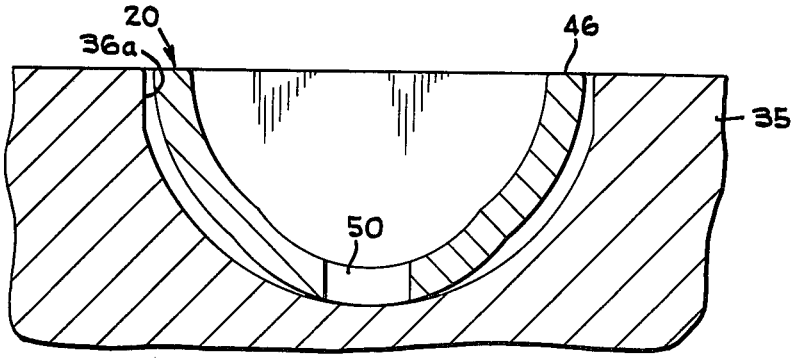
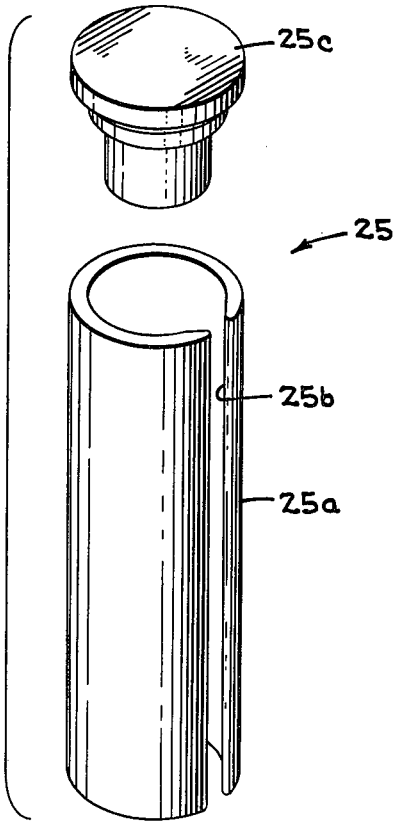
Fig-8

DEVICE FOR USE IN THE WRAPPING OF COINS

BACKGROUND OF THE INVENTION

The present invention relates to devices for use in the wrapping of coins and more particularly to a device for use in the wrapping of coins in which the device is employed for counting coins.

In the U.S. Pat. to Howard, No. 3,085,378, there is disclosed a tube of a predetermined diameter to receive a column of coins of a selected denomination. When the tube is properly stacked with coins of a given denomination, the number of coins so stacked will be of a count to fill a cylindrical wrapper for such coins with a prescribed number of coins. A wrapper may be inserted between the inner wall of the tube and the coins to transfer the coins from the tube to the cylindrical wrapper.

In the U.S. Pat. to Gates No. 3,163,170 is a scoop for use in the holding and counting of coins. The trough of the scoop is marked to enable an operator to determine the number of coins in the scoop. Each trough of the scoop is used for a selected denomination of a coin. A stack of coins of a given denomination is stacked in the trough of the scoop. A cylindrical wrapper placed about the trough of the scoop enables the coins to be transferred from the scoop into the cylindrical wrapper.

In the British Pat. to George Henry Julius Gillard, No. 18,490, accepted on Feb. 27, 1897, there is disclosed a scoop for counting coins. The length of each scoop is related to the denomination of the coin to be wrapped. When the scoop is filled with a stack of coins of a given denomination, the coins of a predetermined count are then transferred to a wrapper.

The applicant of the present application filed on Nov. 13, 1968, an application entitled "Coin Roll Forming Device", Ser. No. 775,293, now abandoned. The application disclosed a coin roll forming device comprising a tube of a predetermined diameter for a coin of a selected denomination and an axial length of a predetermined dimension. When the tube was filled to capacity with a stack of coins of a preselected denomination, the number of coins therein was of a count of a conventional cylindrical wrapper. The coins in the tube were transferred to the cylindrical wrapper by the placement of the cylindrical wrapper about the tube and removing the tube from the cylindrical wrapper.

Heretofore, coin holders used in the wrapping of coins were marked with indicia to show the count of coins for various denominations. Thus, it was necessary for the reader thereof to be able to recognize numerical designations on a tube or the like. In other instances, the coin holders were a prescribed length for each denomination of coins to have a count for each denomination to fill a cylindrical wrapper. As a consequence thereof, there was a separate coin holder for each denomination of the coins.

SUMMARY OF THE INVENTION

A device for use in the wrapping of coins in which a tray has a plurality of receptacles. There is a receptacle for each of various coin denominations. At one end of each receptacle is a coin counter abutment wall projecting into its associated receptacle. The extent of the projection of the coin counter abutment wall into the receptacle is determined by the denomination of the coin and the number of such coins to be wrapped by a wrapper. Removably received by the receptacles, respectively, is a coin holder which is indexed to occupy a predetermined location within the receptacle. When the coin holder is properly positioned in the receptacle and a column of coins fills the space between a rear wall of the coin holder and the coin count abutment wall, the coin holder holds a predetermined number of coins of a selected denomination to be transferred into a wrapper.

By virtue of this arrangement, the need for numerical designations on the coin holder has been obviated in order for a coin holder to transfer a predetermined number of coins of a selected denomination into a cylindrical wrapper. Also, the need for a separate coin holder for each coin denomination of a predetermined width or length has been obviated in order for a coin holder to transfer a predetermined number of coins of a selected denomination into a cylindrical wrapper.

A feature of the present invention is that the tray holds a removable cylindrical wrapper holder for each denomination of the various coins. Disposed within each of the wrapper holders is a cylindrical wrapper of the denomination of the coin identified therewith. Each wrapper holder has a cap which serves as a false bottom, so that the coins remain above the wrapper. The coin holder transfers into the wrapper disposed within the wrapper holder of the designated coin denomination a column of coins of a predetermined count of the same denomination. An axial slot is formed in the cylindrical wall of each of the wrapper holders to facilitate the removal of the wrapper containing the coins from the wrapper holder.

Another feature of the present invention is that the tray includes wells for removably receiving coin wrapper storage bins. There is a coin wrapper storage bin for each coin denomination of the various coin denominations.

DESCRIPTION OF THE DRAWINGS

FIG. 7 is an end enlarged fragmentary section view taken along line 7—7 of FIG. 1 illustrating the coin holder shown in FIGS. 5 and 6.

FIG. 8 is a perspective exploded view of the wrapper holder used in the device shown in FIG. 1.

DESCRIPTION OF THE PREFERRED EMBODIMENT

Figure 1:
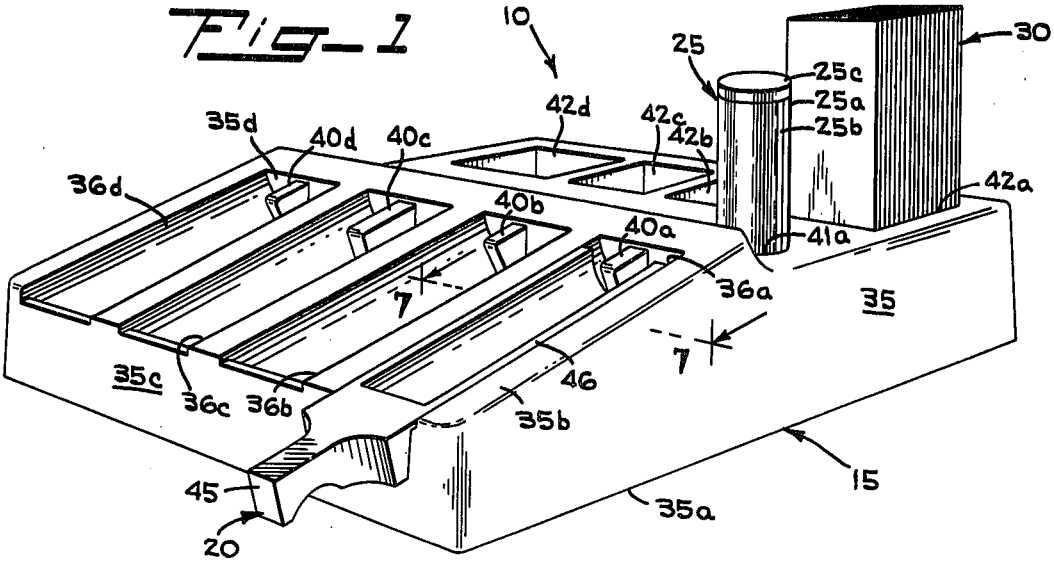
FIG. 1 is a perspective view of the device used for wrapping coins embodying the present invention.
Figure 2:
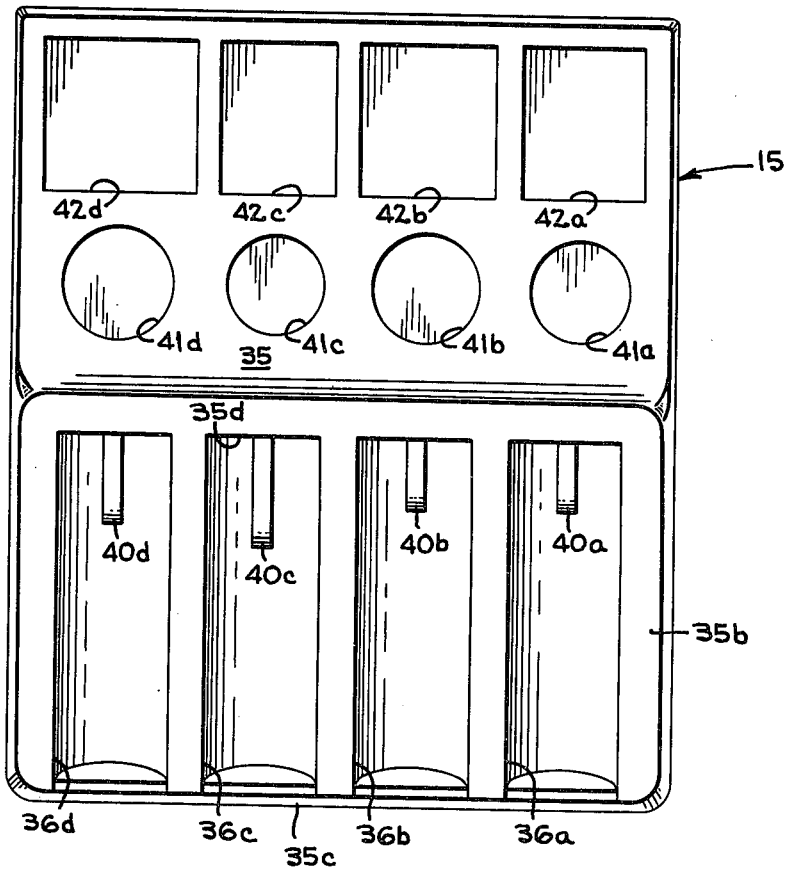
FIG. 2 is a plan view of a tray employed in the device shown in FIG. 1.
Figure 3:
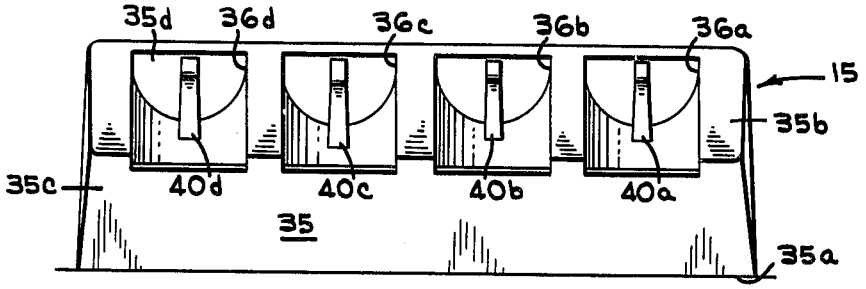
FIG. 3 is a front elevation view of the tray shown in FIG. 2.
Figure 4:
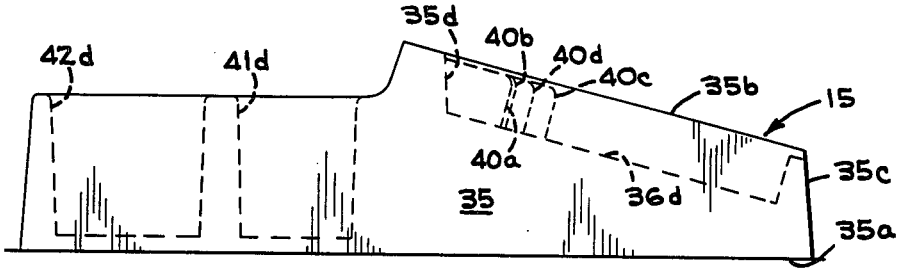
FIG. 4 is a side elevation view of the tray shown in FIGS. 2 and 3.

Illustrated in FIG. 1 is a device 10 for use in the wrapping of coins comprising a tray 15, a coin holder 20, and a plurality of coin wrapper holders 25 and a plurality of coin wrapper containers 30 for storing coin wrappers. Only one coin wrapper holder 25 and only one coin wrapper container 30 is shown. In the exemplary embodiment, the tray 15 is made from a molded plastic material.

As shown in FIGS. 1–5, the tray includes a body 35 with a flat, bottom wall 35*a*, which is suitable for resting on a table or a working surface. Formed in the upper incline wall 35*b* of the body 35 are a plurality of upwardly, inclined, parallel receptacles 36*a*–36*d*, which extend between the transverse walls 35*c* and 35*d* of the body 35. Each of the receptacles 36*a*–36*d* represent a denomination of a coin. By way of example, the receptacle 36*a* represents pennies; the receptacles 36*b* represents nickles; the receptacle 36*c* represents dimes; and the receptacle 36*d* represents quarters. The receptacles 36*a*–36*d* extend in a longitudinal direction and have respectively square cross-sectional areas.

Projecting from the forward transverse wall 35*d* of the body 35 in the longitudinal direction of the receptacles 36*a*–36*d*, respectively, are a plurality of parallel coin abutment walls 40*a*–40*d*. There is a coin abutment wall for each receptacle. The extent of the projection for each coin abutment wall, respectively, is determined by the denomination of the coin represented by its associated receptacle and the number of coins to fill a wrapper used to wrap the coins of the denomination designated for its associated receptacle.

Also formed in the body 35 are cylindrical wells 41*a*–41*d*. There is a cylindrical well for each designated coin receptacle, and there is a cylindrical well aligned with each receptacle. Additionally, the body 35 has formed therein a plurality of wells 42*a*–42*b* having rectangular cross-sectional areas. There is a well of rectangular cross-sectional area for each designated coin denomination and there is a well of rectangular cross-sectional area aligned with each cylindrical well. Thus, in the exemplary embodiment, there are four rows. In each row, there is a receptacle, a cylindrical well, and a well with a rectangular cross-sectional area. Each row is identified with a preselected coin denomination.

Illustrated in FIGS. 1 and 5–7 is the coin holder or scoop 20 used in the present invention. In the preferred embodiment, the coin holder 20 is made from a suitable plastic material by injection molding. The coin holder 20 comprises a suitable handle 45. Integrally formed with the handle 45 and projecting therefrom in the longitudinal direction is a coin receiving trough 46. The coin holder 20 is removably disposed in a receptacle. In the exemplary embodiment, the coin holder 20 can be removably disposed in each of the receptacles 36*a*–36*d*, respectively, and, hence, there is a need for only a single coin holder 20 for each device 10.

Figure 6:
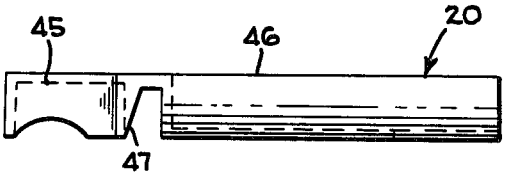
FIG. 6 is a side elevation view of the coin holder shown in FIG. 5.

At the junction between the handle 45 and the trough 46, the coin holder 20 has formed therein a transversely, upwardly directed indexing recess 47 (FIG. 6). The indexing recess 47 is formed in the bottom and side walls of the coin holder 20 and receives the rear wall 35*c* of the tray body 35. In this manner, the coin holder 20 is located or positioned in a predetermined manner in a receptacle.

The inner width of the trough 46 is slightly greater than the diameter of the largest coin of the selected denominations, i.e., the quarter. Coins of the same denomination are placed in the trough 46 in a column to form a stack of coins with a cylindrical configuration. The axis of the column of cylindrical coins extends in the longitudinal direction of both the receptacle and the trough.

Figure 5:
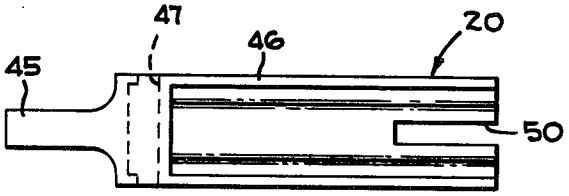
FIG. 5 is a top view of a coin holder employed in the device shown in FIG. 1.

At the free end of the trough 46 is a suitable longitudinally extending slot 50 (FIGS. 5 and 7). The width of the slot 50 is slightly greater than the width of the coin abutment walls 40*a*–40*d*, respectively. The slot 50 receives the coin abutment wall projecting into the receptacle in which the coin holder 20 is located and serves to guide the movement of the coin holder 20 relative to the coin abutment wall.

When the coin holder 20 is properly located in the receptacle, and coins are stacked in a column in the trough 46 to fill the space from the rear wall 20*a* thereof to the coin abutment wall, a predetermined number of coins of the same denomination will be contained in the trough 46 forming a column of a cylindrical configuration with the axis thereof extending longitudinally of the trough 46. The number of coins so stacked is the number of coins required to fill a cylindrical wrapper of the designated denomination of the stacked coins.

It is apparent that the slot 50 of the coin holder 20 can be employed in lieu of the indexing recess 47. When the coin holder 20 is placed in the receptacle without an indexing recess and the open end of the trough 46 is urged inwardly until the transverse wall of the slot 50 engages the transverse wall at the distal end of the coin abutment wall, the coin holder is then properly indexed within the receptacle. An operator now places coins of the same denomination in the trough 46. The coins are stacked in a column to fill the space between the rear wall of the trough 46 at the proximal end thereof and the transverse wall at the free end of the coin abutment wall. When this occurs, there will be a predetermined number of coins of the same denomination stacked in a column to form a cylindrical configuration with the axis thereof extending longitudinally of the trough 46. The number of coins so stacked is the number of coins required to fill a cylindrical wrapper of the designated denomination of the stacked coins.

From the foregoing, it is to be observed that during each operation for wrapping coins of each of the various denominations of coins, the trough 46 will be stacked with a predetermined number of coins of the same denomination required to fill a cylindrical wrapper of the selected denomination. This is accomplished by first placing the coin holder 20 in the receptacle designated for a particular denomination of the coins with the coin holder 20 indexed to occupy a predetermined position in the selected receptacle. Thereupon, coins of the selected denomination are stacked in the trough 46 between the rear wall 20*a* thereof and the transverse wall at the free end of the coin abutment wall projecting into the selected receptacle to form a column of coins having a cylindrical configuration with the axis of the cylinder extending in the longitudinal direction of the trough 46. Now, the coin holder 20 is removed from the receptacle and a predetermined number of coins of the same denomination are stacked in the trough 46.

Wrapper holders 25 (FIGS. 1 and 8) are normally disposed in the wells 41*a*–41*d*, respectively. There is a wrapper holder 25 for each denomination of the coins. For example, the wrapper holder 25 normally disposed in the well 41*a* is for pennies; the wrapper holder 25 normally disposed in the well 41*b* is for nickles; the wrappr holder 25 normally disposed in the well 41*c* is for dimes; and the wrapper holder 25 normally disposed in the well 41*d* is for quarters.

Each wrapper holder 25 comprises a cylindrical body or tube 25*a*, and a cap 25*c*. The tube 25*a* is made of extruded plastic. The cap 25*c* is also made of plastic. Inserted in each tube 25*a* of the wrapper holder 25 is a cylindrical wrapper of the denomination of the coin associated with the cylindrical well in which the wrapper holder 25 is normally disposed. The cylindrical wrapper and the tube 25*a* are concentric. The cap 25*c* forms a false bottom so that the coins remain above the wrapper. The coins stacked in the trough 46 are transferred into the cylindrical wrapper disposed in the tube of the wrapper holder. A slot 25*d* is formed in each tube 25*a* to facilitate the removal of the cylindrical wrapper and the coins contained therein from the wrapper holder 25. The lengths and diameters of the tubes 25*a* may vary dependent on the length and diameter of the coin wrapper to be inserted thereon.

Disposed in each well 42*a*–42*d* is a wrapper storage bin or container 55. Each wrapper storage container 55 has a square cross-sectional area. There is a wrapper storage container 55 for each coin denomination of the cylindrical wrappers. The cylindrical wrappers placed one at a time in the cylindrical wrapper holders 25, respectively, are removed from the associated wrapper storage bin.

While reference herein is made to coins, it is apparent that other similar objects may be employed with the device 10 of the present invention. For example, the concepts herein employed may be applied to the wrapping of tokens, chips, discs and the like.

I claim:

1. A device for use in the wrapping of coins or the like comprising:

(a) a tray, said tray being formed with a plurality of longitudinally extending receptacles, each of said receptacles representing a coin denomination, each of said receptacles at one end thereof having a coin count abutment wall projecting thereinto in the longitudinal direction thereof, the extent of the projection of a coin count abutment wall in the associated receptacle being related to a desired coin count for the coin of the denomination represented by the associated receptacle; and (b) a coin holder adapted to be removably disposed in any one of said receptacles dependent on the denomination of the coins to be wrapped, said coin holder cooperating with said tray to be indexed to occupy a predetermined position in a receptacle, said coin holder comprising a longitudinally disposed trough having a wall at its proximal end and being opened at its free end, said free end of said trough extending at least to said coin count abutment wall, said trough being arranged to receive a stack of coins of the same denomination to form a column of coins with a cylindrical configuration with the axis thereof extending in the longitudinal direction, the stacking of coins in said trough from said wall at its proximal end to said coin count abutment wall fills said trough with a predetermined number of coins of the same denomination.

2. A device as claimed in claim 1 wherein said tray has a rear transverse wall and a forward transverse wall, said coin abutment wall projecting from said forward abutment wall in the direction of said rear abutment wall, said coin holder being formed with an indexing slot in the bottom wall thereof to receive said rear wall of said tray for indexing said coin holder to occupy a predetermined position in a receptacle of said tray.

3. A device as claimed in claim 1 wherein said coin holder is formed with a longitudinally extending slot at its free end to receive said coin abutment wall, said slot being formed to define a transverse wall, the engagement between said transverse wall defined by said slot and said coin abutment wall indexes said coin holder to occupy a predetermined position in a receptacle of said tray.

4. A device as claimed in claim 2 wherein said coin holder is formed with a longitudinally extending slot at its free end to receive said coin abutment wall.

5. A device as claimed in claim 1 wherein said tray is formed with a plurality of cylindrical wells, said device comprising a plurality of cylindrical coin wrapper holders removably received by said cylindrical wells respectively.

6. A device as claimed in claim 5 wherein each of said cylindrical coin wrapper holders is formed with an axial slot in the cylindrical well thereof.

7. A device as claimed in claim 3 wherein said tray is formed with a plurality of wells, said device comprising a plurality of coin wrapper containers removably received by said last-mentioned wells respectively.

8. A device as claimed in claim 6 wherein said tray is formed with a plurality of wells, said device comprising a plurality of coin wrapper containers removably received by said last-mentioned wells respectively.

9. A device as claimed in claim 4 wherein said tray is formed with a plurality of cylindrical wells, said device comprising a plurality of cylindrical coin wrapper holders removably received by said cylindrical wells respectively.

10. A device as claimed in claim 9 wherein said tray is formed with a plurality of wells, said device comprising a plurality of coin wrapper containers removably received by said last-mentioned wells respectively.

* * * * *